United States Patent [19]

Camilleri

[11] 4,067,570

[45] Jan. 10, 1978

[54] FASTENING METHOD FOR FLEXIBLE MATERIAL

[76] Inventor: Thomas M. Camilleri, 277 Ave. W, Brooklyn, N.Y. 11226

[21] Appl. No.: 673,042

[22] Filed: Apr. 2, 1976

[51] Int. Cl.[2] ..... A63D 5/02; A44G 17/00

[52] U.S. Cl. ..... 273/47; 24/204; 24/73 A

[58] Field of Search ..... 24/204, 17 A, 17 AP, 24/73 A, 16 PB, 16 R; 273/47, 53

[56] References Cited

U.S. PATENT DOCUMENTS

| | | | |
|---|---|---|---|
| 406,106 | 7/1889 | Lyon | 24/204 |
| 974,400 | 11/1910 | Lee | 273/47 |
| 1,570,551 | 1/1926 | Bishop | 273/47 |
| 3,154,827 | 11/1964 | Gentry | 24/204 |
| 3,899,171 | 8/1975 | Haller | 273/47 |

FOREIGN PATENT DOCUMENTS

| | | | |
|---|---|---|---|
| 863,774 | 2/1971 | Canada | 273/53 |
| 1,057,882 | 2/1967 | United Kingdom | 24/16 PB |

*Primary Examiner*—Bernard A. Gelak
*Attorney, Agent, or Firm*—Donald J. Perrella

[57] ABSTRACT

A strong flexible material is fastened to itself by a plurality of slits and cut-out sections which form flaps which are pushed through openings formed by a second plurality of slits and smaller cut-out sections.

5 Claims, 7 Drawing Figures

30
22
20
21
23
24
40
7
6

FASTENING METHOD FOR FLEXIBLE MATERIAL

BACKGROUND OF THE INVENTION

There are many industrial and commercial instances when a flexible material must be fastened to itself when, for example, it is necessary to attach it to a supporting member. Perhaps the most common fastening method is to bend the material back upon itself so as to form a loop and then to permanently secure the loop by mechanical means, e.g., stitching, stapling, snap fasteners, and the like, or by chemical means, e.g., the use of bonding agents such as glues or adhesives, and the like. Such methods have in common the use of a fastening means other than the material itself. The fastening means is often weaker than the material and often ruptures under service conditions necessitating replacement of the failed member. Replacement usually requires disassembly of the apparatus of which the failed member was part.

OBJECTS OF THE INVENTION

It is an object of the present invention to provide a fastening method for a flexible material which uses only the material itself and does not require the use of extraneous means. Another object is to provide a fastening method for a flexible material whereby the material can be installed without disassembly of the apparatus of which it is a part. These and other objects of the present invention will be apparent from the following description.

SUMMARY OF THE INVENTION

A strong flexible material is fastened to itself by means of a first plurality of slits running inwardly from an edge and which in conjunction with a plurality of cut-out sections form flaps which are pushed through a plurality of openings formed by a second plurality of slits and smaller cut-out sections offset with respect to the first plurality of slits and cut-out sections.

DETAILED DESCRIPTION

Figure 1:
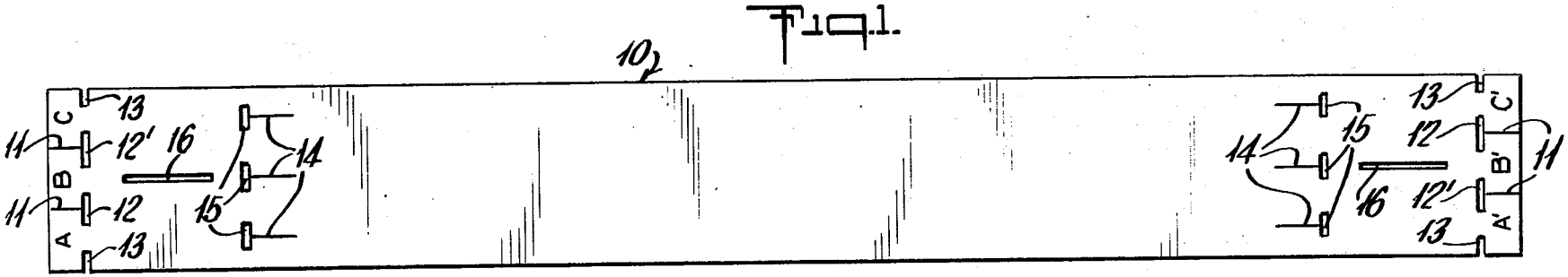
FIG. 1 is a plan view of an unfastened ball check belt.

FIG. 1 shows a ball check belt 10 according to the present invention in unfastened condition. The ball check belt presses against a returning bowling ball and facilitates engagement of the ball by the tire wheel which delivers it to the bowler pickup stand at the front of the alley. The ball check belt is formed in conventional manner of a carcass having one or more plies (not shown as conventional) of belting material. Typically it may be formed of an intermediate nylon duck covered on top and bottom with neoprene and having a total thickness of about ⅛ inch. Each end is provided with a plurality of slits 11 beginning at the end and perpendicular thereto, each slit terminating in a rectangular cutout section 12 perpendicular to slit 11 and about equal in width to the length of slit 11. Aligned with cutout sections 12 and extending inwardly along each side of the belt at each end is a Ushaped cutout section 13 about half the length of cutout section 12. The slits and cutout sections form a plurality of flaps lettered A, B, and C, respectively at one end and A′, B′ and C′ at the other end. Further in from each end is another plurality of slits 14 about equal in length to slits 11, each slit 14 terminating in a rectangular cutout section 15 perpendicular to slit 14. Cutout sections 15 are smaller, say about half the length of cutout sections 12. Both slits 11 and 14 and sections 12 and 15 are staggered or offset with respect to one another. The cutout sections 12 and 14 face each other with no slits between them, the slits being located on the far side of the cutout sections 12 and 14. A longitudinal cutout section 16 is optionally present between sections 12 and 15 in the case of stiffer materials to provide increased flexibility.

Figure 2:
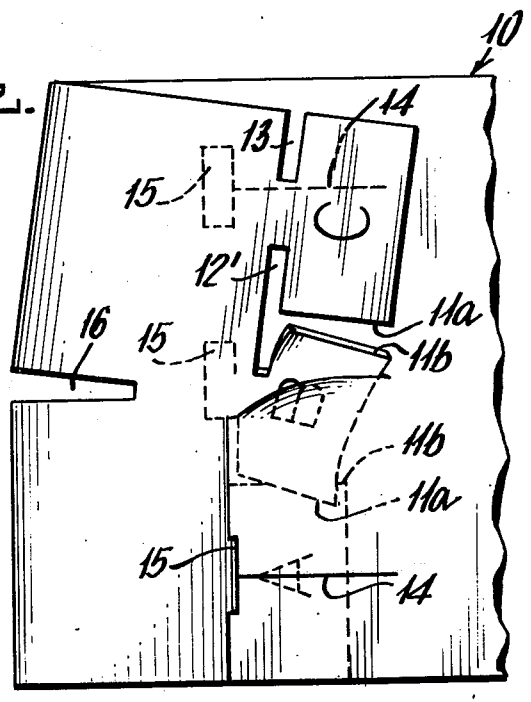
FIG. 2 is a plan view of one end being fastened to itself to form a loop.

To form a secure loop the end of the belt is folded back towards the center of the belt so that slits 11 are in proximity to slits 14. The adjacent edges **11*a* and 11*b* formed by the slits 11 are separated and the respective flaps are pushed through the slit 14 intermediate the edges of each flap. Thus, as shown in FIG. 2 flap A has been pushed through the bottom slit 14, flap B is being pushed through the middle slit 14, and flap C in turn will be pushed through top slit 14**.

Figure 4:
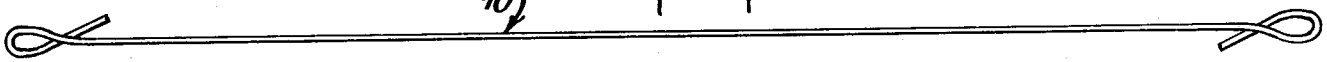
FIG. 4 is a side elevation of the belting material of FIG. 1 with a loop at each end formed by fastening the material to itself.
Figure 3:
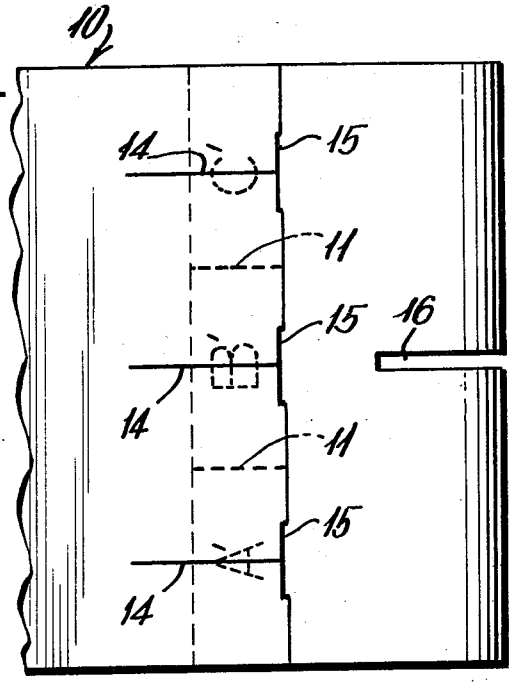
FIG. 3 is a plan view of the other end fastened to itself to form a loop.

FIG. 3 shows the appearance of the belt after each of the flaps has been inserted through the appropriate slit 14. As shown in FIG. 4, the belt may be folded back on either its top (shown at right side of figure) or its bottom (shown at left side of figure) to produce a loop which is securely fastened without the use of extraneous means. A rod (not shown) may be inserted through the loops thus formed to support or stretch taut belt 10. When an apparatus containing such supporting rods is fully assembled, the belt 10 may be installed thereon over the supporting rods without disassembly of the apparatus by folding each end over one of the supporting rods and pushing the flaps through the respective slit in the manner previously described thereby securely fastening the belt to itself and thus attaching it to the rod. It may also be removed without disassembly of the apparatus by reversing the foregoing procedure.

While the fastening method of the present invention has been described with reference to a ball check belt, it is to be understood that the fastening method has general application and may be used for all types of belting materials and elastomeric materials. In particular it may be applied advantageously to a pin curtain for an automatic pinsetter (Brumswick) or pinspotter (AMF). The pin curtain consists of a transverse generally vertically positioned curtain mounted above the pit and extending downwardly thereinto adjacent to and in front of the backstop. The curtain is held taut and inclined away from the backstop so that when a pin strikes the curtain it is deflected downwardly into the pit and prevented from flying back into the gutters or up the alley or upwardly into the mechanism of the pin spotting machine. The pin curtain typically is formed of a sheet of flexible material such as rubber, or laminated rubber and canvas leather or any suitable fabric or sheet material which is strong and durable and can stand flexing without breaking or tearing. The pin curtain may be attached to a rod at its top and bottom. When the pin curtain eventually has to be replaced, the pinsetter or pinspotter must be partially disassembled to remove the rods, after which a new curtain is installed on the rods and the pinsetter or pinspotter mechanism is reassembled. The fastening method of the present invention, however, obviates this disadvantage and permits removal and installation of the pin curtain without diassembly of the pin spotter.

Figures 5, 6, 7:
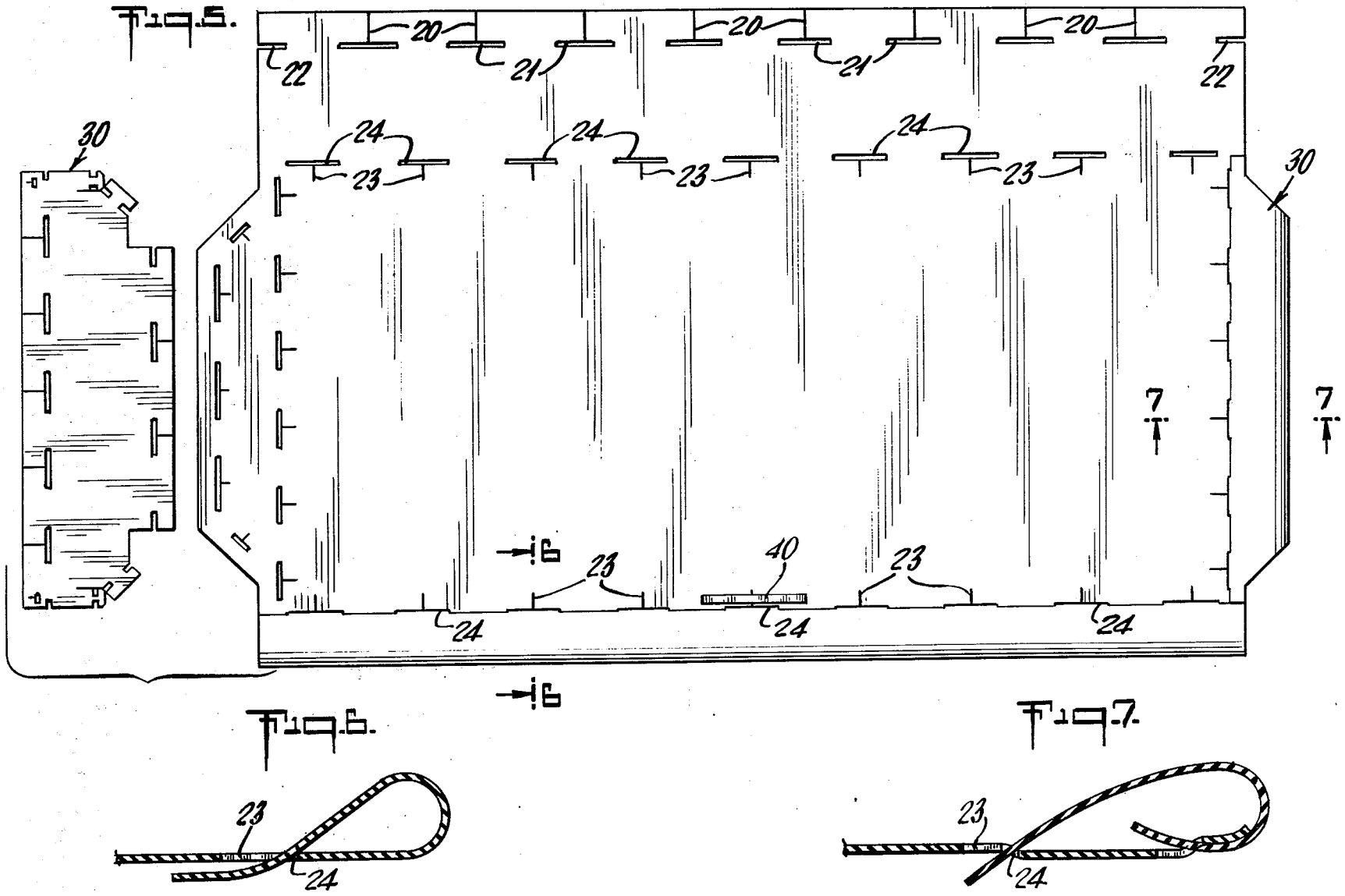
FIG. 5 is a plan view of a pin curtain with one longer side fastened to itself to form a loop and a reinforcing section fastened to one shorter side.
FIG. 6 is a section taken along the line 6—6 of FIG. 5.
FIG. 7 is a section taken along the line 7—7 of FIG. 5.

As shown in FIG. 5 the bottom of the pin curtain is provided with a plurality of slits 20 beginning at the edge of the top or bottom and perpendicular to the edge, each slit terminating in a rectangular cut-out section 21 perpendicular to slit 20. Aligned with cut-out sections 21 and extending inwardly along each side is a U-shaped cut-out section 22 about half the length of section 21. Further toward the center is a second plurality of slits 23 about half the length of slits 20, each slit 23 terminating in a rectangular cut-out section 24 being smaller, say about half the length of sections 21. The slits 20 and 23 and the cut-out sections 21 and 24 are staggered or off-set with respect to one another. The cut-out sections 21 and 24 face each other with no slits between them, the slits being located on the far side of the cut-out sections 21 and 24. To secure the pin curtain to itself, the flaps which are formed by adjacent slits 20 and adjacent cut-out sections 21 are folded back so as to overlie slits 23 and cut-out sections 24 and the flap is then pushed through the underlying slit 23 in the manner previously described. The top of the pin curtain contains a similar arrangement of staggered or offset slits and cut-out sections and is shown in fastened condition. The vertical sides of the pin curtain are subject to the greatest wear and abrasion and tears and cuts occur here most frequently. However, by providing appropriate slits and cut-out sections according to the present invention along these sides a protecting and reinforcing strip having complementary slits and cut-out sections may be fastened to the side to absorb the wear and abrasion and spare the pin curtain itself. When the protecting reinforcing strip eventually becomes split or torn, it can simply be removed and a new protecting and reinforcing strip installed without having to remove the pin curtain. A separate protecting and reinforcing member 30 having appropriately located slits and cut-out sections according to the present invention is shown at the left side of FIG. 5. It may be fastened to the sides of the pin curtain for added reinforcement and protection. The protecting and reinforcing member is shown attached on the right side of FIG. 5.

In the case of more flexible materials which may have tendency to pull the flaps back through the inner cut-out section when subjected to extreme stress, a stiff reinforcing member 40 made of wood or metal may be attached to the base of the flap after the flap is pushed through the cut-out section. The reinforcing member may be fastened in any suitable means, for example, by snap fasteners. In this manner even very flexible materials will remain secured even under extreme stress while still permitting installation and removal without disassembly of the apparatus.

While specific embodiments of the invention have been described in the present application, it is to be understood that various modifications may be employed. For example, the slits may be of varying size and slits 23 may be equal to or longer than slits 20. Further the space between adjacent slits may be greater or smaller than illustrated with corresponding changes in the size of the cut-out sections. The strength of the fastening means of the present invention may be increased, in general, by increasing the distance between the slits.

What is claimed is:

1. Means for fastening an edge of a strong, flexible material to the body of the material to form a loop at the edge comprising a first plurality of slits beginning at an edge and extending inwardly perpendicular thereto, the slits terminating in a plurality of substantially rectangular cut-out sections perpendicular and symmetrical thereto, a second plurality of slits located inwardly of the first plurality of slits, the second plurality of slits being substantially parallel to the first plurality of slits and terminating in a second plurality of substantially rectangular cut-out sections perpendicular and symmetrical thereto, the first and second plurality of cut-out sections facing each other with no slits between them, and the first and second plurality of slits and cut-out sections being equidistantly offset with respect to each other.

2. A ball check belt for an automatic pinsetting or pinspotting machine having fastening means according to claim 1.

3. A pin curtain for an automatic pinsetting or pinspotting machine having fastening means according to claim 1.

4. A pin curtain according to claim 3 having additional fastening means according to the present invention on at least one vertical side of the pin curtain for attaching a reinforcing and protecting strip.

5. A pin curtain according to claim 4 having a reinforcing and protecting strip attached to each side.

* * * * *